US007320442B2

(12) United States Patent
Bosio

(10) Patent No.: US 7,320,442 B2
(45) **Date of Patent: *Jan. 22, 2008**

(54) ON-OFF SHOWER HEAD

(75) Inventor: Orlando Bosio, Casaloldo (IT)

(73) Assignee: AMFAG S.p.A., Castel Goffredo (IT)

( * ) Notice: Subject to any disclaimer, the term of this patent is extended or adjusted under 35 U.S.C. 154(b) by 199 days.

This patent is subject to a terminal disclaimer.

(21) Appl. No.: 10/984,784

(22) Filed: Nov. 10, 2004

(65) Prior Publication Data

US 2005/0103905 A1 May 19, 2005

(30) Foreign Application Priority Data

Nov. 14, 2003 (IT) ..... MN2003A0042

(51) Int. Cl.
*B05B 1/30* (2006.01)
*B05B 9/00* (2006.01)

(52) U.S. Cl. ..... 239/569; 239/443; 239/444; 239/445; 239/446; 239/447; 239/448; 239/449; 239/436; 239/562; 239/312

(58) Field of Classification Search ..... 239/436, 239/562, 443–49, 312, 428.5, 563, 586, 590.5, 239/590.3, 530, 583, 477, 478, 390, 397, 239/394, 533.15, 569
See application file for complete search history.

(56) References Cited

U.S. PATENT DOCUMENTS

| | | | | |
|---|---|---|---|---|
| 4,151,957 | A * | 5/1979 | Gecewicz et al. | 239/381 |
| 4,303,201 | A * | 12/1981 | Elkins et al. | 239/381 |
| 4,629,124 | A * | 12/1986 | Gruber | 239/428.5 |
| 4,674,687 | A * | 6/1987 | Smith et al. | 239/447 |
| 5,145,114 | A * | 9/1992 | Monch | 239/126 |
| 5,246,169 | A * | 9/1993 | Heimann et al. | 239/447 |
| 5,551,637 | A * | 9/1996 | Lo | 239/394 |
| 5,806,771 | A * | 9/1998 | Loschelder et al. | 239/446 |
| 5,937,905 | A * | 8/1999 | Santos | 137/871 |
| 6,045,062 | A * | 4/2000 | Bosio | 239/443 |
| 6,290,147 | B1 * | 9/2001 | Bertrand et al. | 239/444 |
| 6,302,339 | B1 * | 10/2001 | Chou | 239/581.2 |
| 2006/0151632 | A1 * | 7/2006 | Larsen | 239/436 |

FOREIGN PATENT DOCUMENTS

EP 0 856 361 A 8/1998

* cited by examiner

*Primary Examiner*—Kevin Shaver
*Assistant Examiner*—James S. Hogan
(74) *Attorney, Agent, or Firm*—Modiano & Associati; Albert Josif; Daniel J. O'Byrne

(57) ABSTRACT

An on-off shower head, comprising an outer enclosure and a jet opening and closing device, further comprising water conveyance means arranged within the enclosure and adapted to prevent any contact of the water with the enclosure.

10 Claims, 6 Drawing Sheets

ON-OFF SHOWER HEAD

BACKGROUND OF THE INVENTION

It is known that shower heads, used for example to supply water to kitchen sinks or to serve sanitary fittings, operate so that they are normally closed and are opened to form a jet in output by operation of a button or lever by the user.

Shower heads of this kind are known as on-off shower heads.

Conventional shower heads comprise an outer enclosure, which is designed to convey the water within them, and this fact is a severe constraint in selecting the material to be used to provide said enclosure.

The materials of high aesthetic value that are used in fact have a high heat conductivity, and therefore the user who holds the shower head is considerably affected by the flow of hot water; moreover, such materials, when they are brought to the high temperatures required during the enclosure manufacturing process, undergo deformations that are not compatible with the precision features required in the couplings with which the enclosure is necessarily provided for correct conveyance of the water.

SUMMARY OF THE INVENTION

The aim of the present invention is therefore to provide an on-off shower head that ensures a high aesthetic value, comfortable user grip, and the possibility to provide any kind of finish on the outer enclosure.

This aim and other objects of the present invention are achieved by an on-off shower head according to the invention, comprising an outer enclosure and a jet opening and closing device, characterized in that it comprises water conveyance means arranged within said enclosure, which are adapted to prevent any contact of the water with said enclosure.

BRIEF DESCRIPTION OF THE DRAWINGS

Further characteristics and advantages will become better apparent from the description of a preferred but not exclusive embodiment of the on-off shower head according to the invention, illustrated by way of non-limiting example in the accompanying drawings, wherein.

DESCRIPTION OF THE PREFERRED EMBODIMENTS

Figure 1:
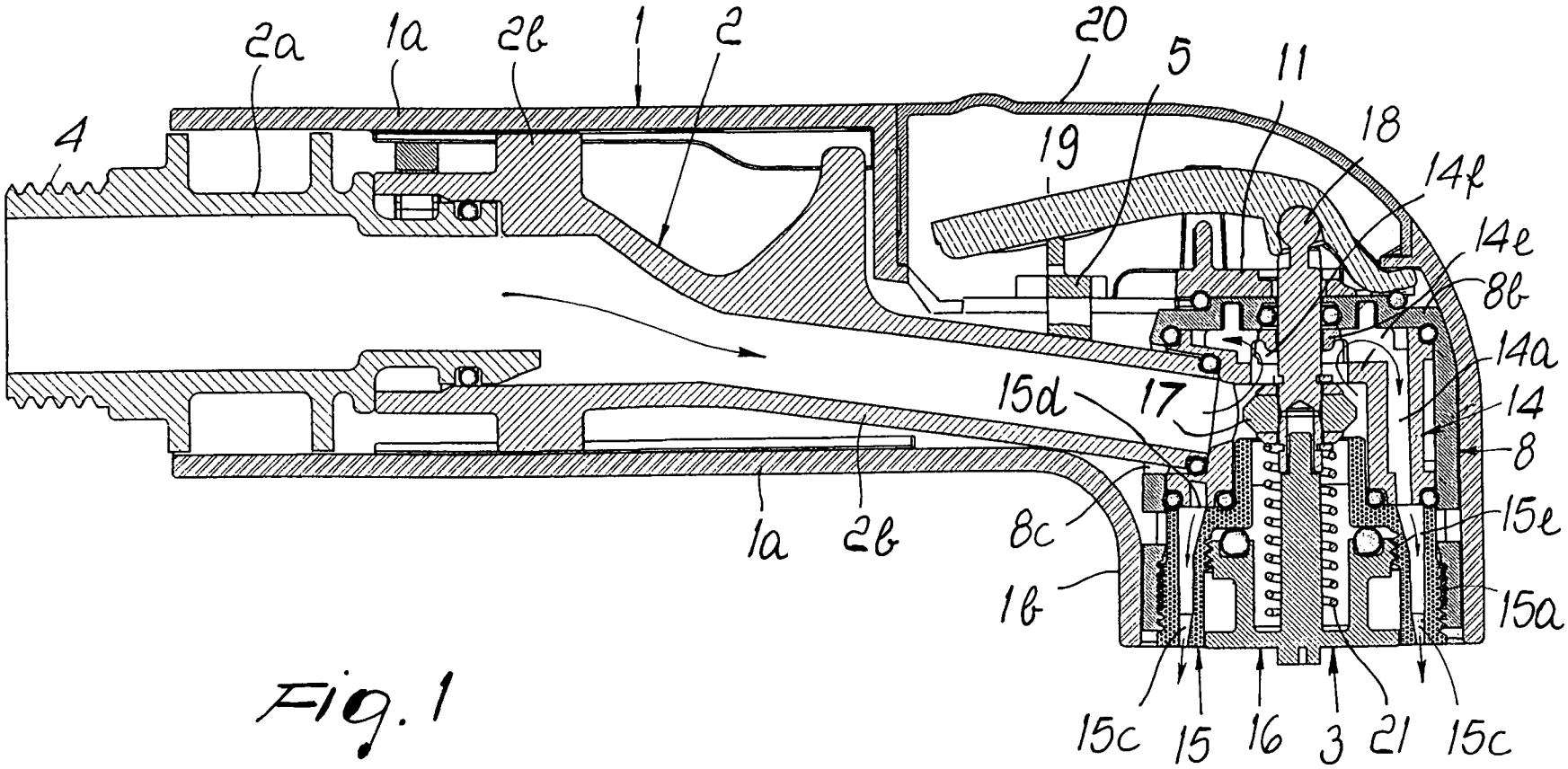
FIGS. 1 and 2 are longitudinal sectional views of the invention, respectively in the positions for opening and closing the jet.

With reference to the figures, reference numeral 1 generally designates the outer enclosure of the shower head, which is shaped so as to define a tubular portion 1*a*, which is connected to the head-shaped portion 1*b* and is designed to contain water conveyance means, which comprise a device for opening and closing the jet.

Such conveyance means are adapted to prevent any contact of the water with the outer enclosure and comprise a first elongated insert, generally designated by the reference numeral 2, which comprises two mutually rotatable segments 2*a* and 2*b*, and a second cylindrical insert, generally designated by the reference numeral 3, both of which are designed to be locked to each other and contained respectively within a tubular portion 1*a* and within a head-shaped portion 1*b* of the outer enclosure.

Figure 2:
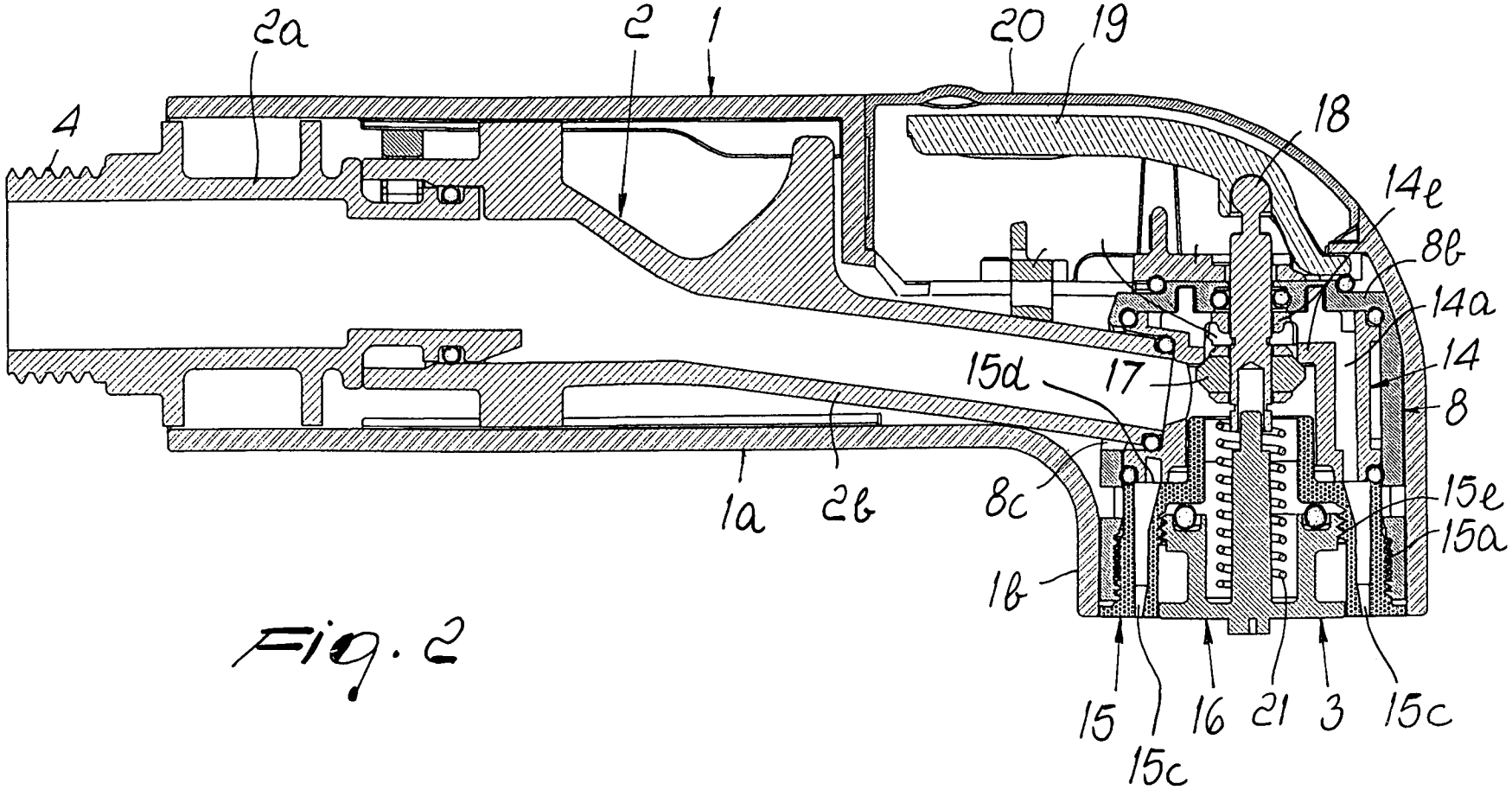
Figure 3:
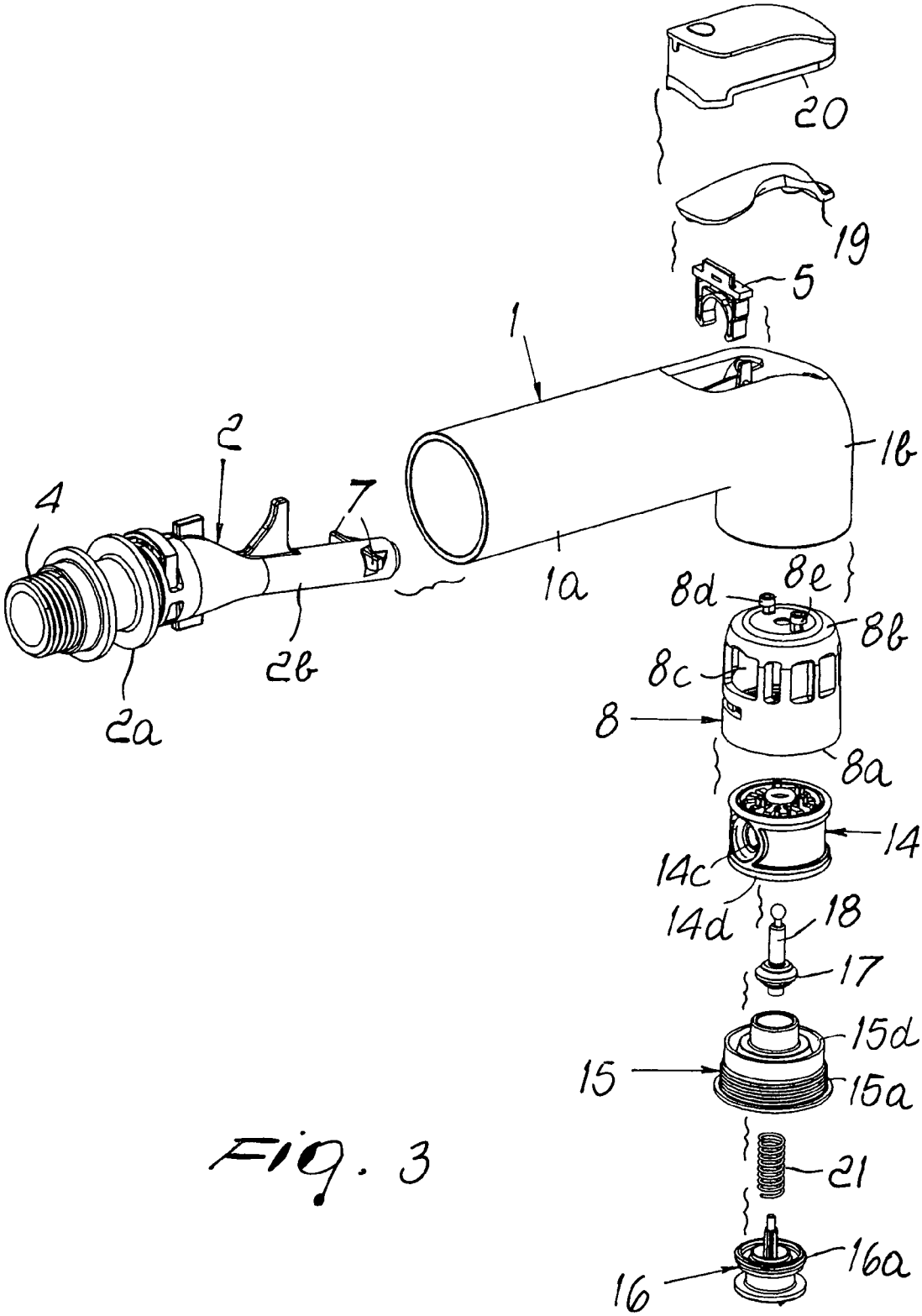
FIG. 3 is an exploded view of the shower head according to the invention.
Figure 4:
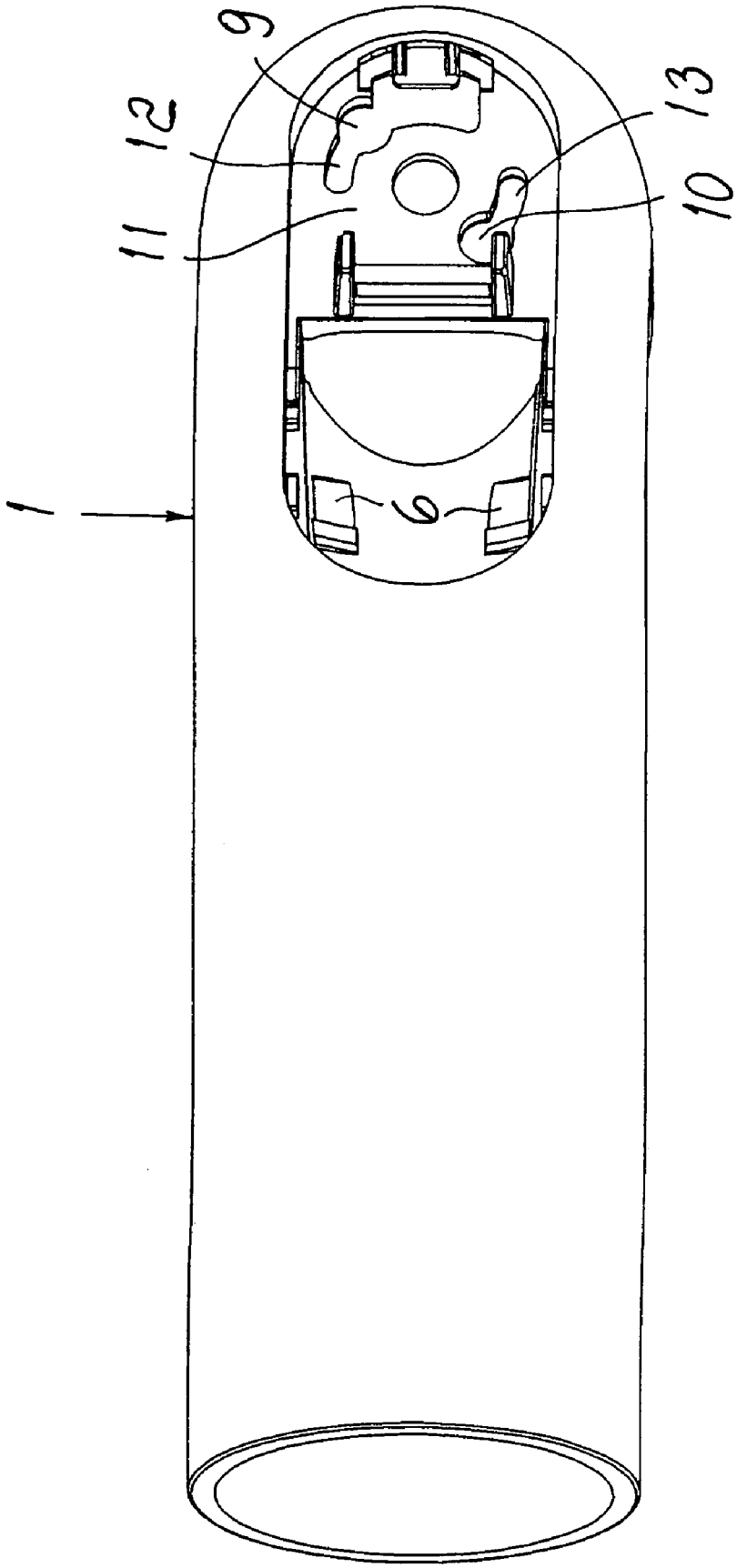
FIG. 4 is a top plan view of the outer enclosure.
Figure 5:
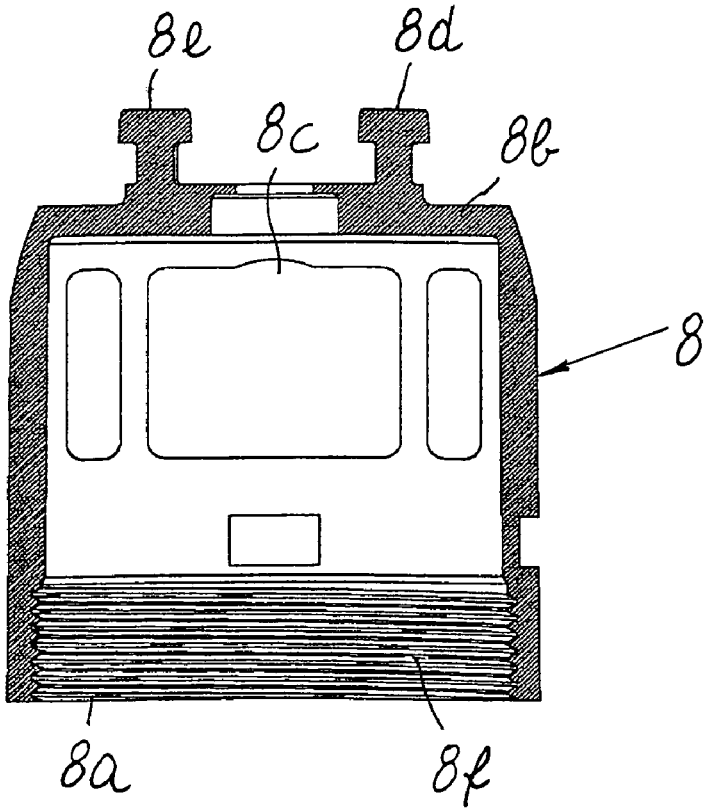
FIG. 5 is a sectional elevation view of the cylindrical wall.
Figure 6:
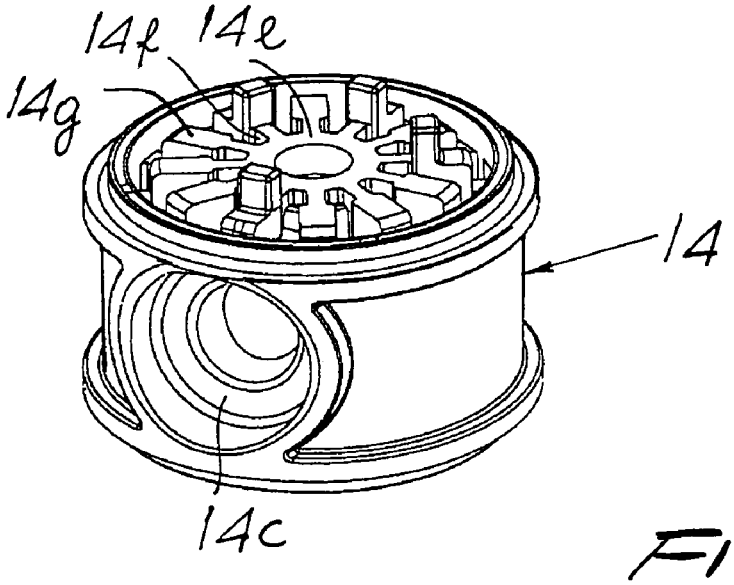
FIGS. 6 and 7 are two perspective views of the distribution unit.

The elongated insert 2 comprises, at the end that protrudes from the outer enclosure 1, a threaded portion 4 for connection to a water feed duct, and is provided with axial locking means so as to prevent its extraction once it has been associated with a cylindrical enclosure 3 as shown in FIGS. 1 and 2, said means being engaged on the outer enclosure 1.

Such means comprise in particular a U-shaped element 5, which is adapted to be associated with a receptacle 6 formed on the internal surface of the enclosure 1 by abutting against a protrusion 7 provided on the elongated insert 2.

The cylindrical insert 3 also is provided with axial locking means, which are adapted to ensure its stability in its receptacle, such means being described in greater detail hereinafter.

The cylindrical insert 3 is now described in detail and comprises a plurality of elements, which form a compact unit once they are assembled.

The first of those elements is constituted by a cylindrical wall 8, which is open at an end 8*a* that is directed toward the outside of the outer enclosure 1 and is provided with a top or upper portion 8*b* at the other end; an opening 8*c* for insertion of the end of the elongated insert 2 is further arranged at the side wall.

The cylindrical wall 8 is provided with means for coupling to the outer enclosure 1, which comprise two mushroom-shaped tabs 8*d*, 8*e* that protrude from the top 8*b* and are adapted to enter, by moving in an axial direction, respective holes 9 and 10 provided in a flat ridge 11 that is rigidly coupled to said enclosure 1 in order to lock the cylindrical wall upon rotation thereof about its own axis, entering slots 12 and 13 formed as a continuation of said holes 9 and 10; rotation in the opposite direction is prevented by insertion of the elongated insert 2 in an opening 8*c*.

The second element of the cylindrical insert 3 is constituted by a distribution unit 14, which is accommodated within the cylindrical wall 8 and is kept in position in abutment against the top 8*b* thereof, as described in greater detail hereinafter.

The distribution unit is provided with channels, 14*a*, for the flow of water, which are comprised in a peripheral ring 14*b* provided with a port 14*c* that is designed to be mated to the end of the elongated insert 2.

Figure 7:
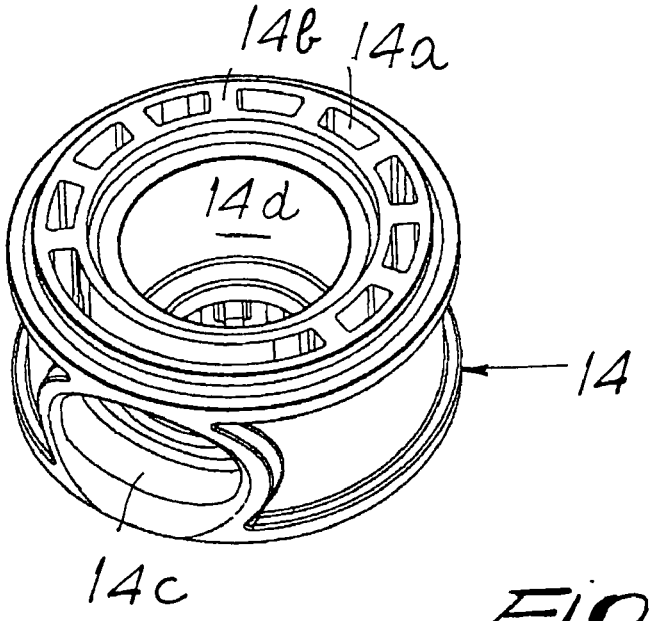
Figure 8:
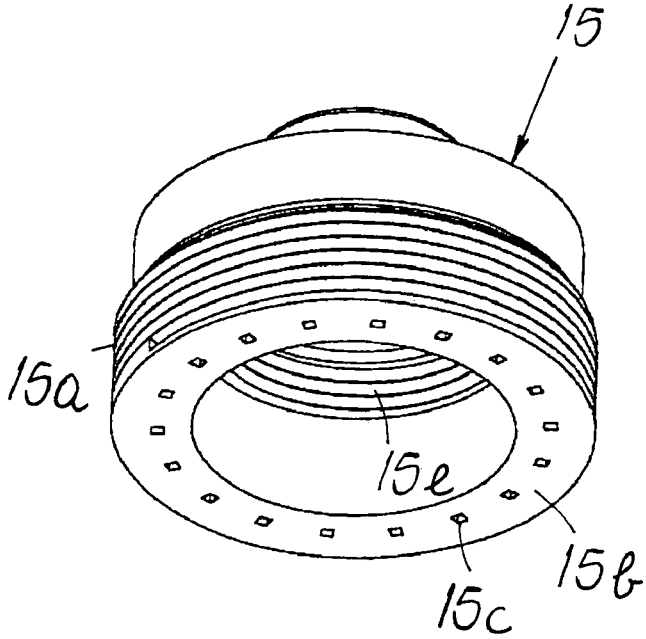
FIG. 8 is a perspective view of the annular element.

The portion of space that is comprised within the ring 14*b* is open at an end 14*d* that is directed toward the outside of the enclosure and is shown in FIG. 7, and has, at its other end, a cap 14*e*, which comprises water flow ports 14*f*; a plurality of ridges 14*g* ensure connection between the channels 14*a* and the ports 14*f*.

The third element of the cylindrical insert 3 is constituted by an annular element 15, which is associated by means of a thread 15*a* with the cylindrical wall 8 at a thread 8*f* of said cylindrical wall.

The annular element delimits a central portion of space, which is comprised within a peripheral ring 15*b* and is provided with channels 15*c* for the flow of water, which are designed to be arranged as a continuation of the channels 14*a* provided in the distribution unit 14, and comprises a surface 15*d*, which is adapted to abut against said distribution unit in order to keep it in position in abutment against the top 8*b* of the cylindrical wall 8.

Moreover, the annular element 15 is provided with a thread 15*e*, which allows to assemble a plug 16, by means of the thread 16*a* thereof, and is adapted to close outwardly the central portion of space comprised within the annular element.

Finally, the reference numeral 17 designates a flow control element, which is associated with a rod 18, which is adapted to be operated by a user by means of a lever-type button 19, protected by a hood 20, in contrast with a spring 21 in order to open and close the jet by moving between the position shown in FIG. 1 and the position shown in FIG. 2, respectively without contact and in contact with a cap 14*e* of the distribution unit 14.

When the user arranges the flow control element 17 in the position of FIG. 1, water flows through the shower head in the directions indicated by the arrows shown in said figure, while in the position shown in FIG. 2 the water enters the central portion of space of the annular element 15 and is prevented from exiting by the presence of the plug 16.

Suitable gaskets complete the invention as shown in FIGS. 1 and 2.

The described invention is susceptible of numerous modifications and variations, all of which are within the scope of the appended claims; thus, for example, the outer enclosure may have any shape, with a consequent suitable shape of the conveyance means.

The insert designed to be contained within the head-shaped portion of the outer enclosure may assume any shape, also in relation to the means for fixing to the outer enclosure, and may also lack the means for axial locking with respect to said enclosure; the insert designed to be contained in the tubular portion of the outer enclosure also may be locked in any manner and may have any shape, for example a monolithic shape.

Moreover, the annular element may be provided with a monolithic screen instead of the plug.

The disclosures in Italian Patent Application no. MN2003A000042 from which this application claims priority, are incorporated herein by reference.

What is claimed is:

1. An on-off shower head, comprising: an outer enclosure, a jet opening and closing device, water conveyance means arranged within said enclosure for preventing any contact of the water with said enclosure, said outer enclosure being shaped to form a tubular portion that is open at one end and is connected at an other end to a head-shaped portion, said water conveyance means comprising a first insert and a second insert that are lockable to each other and that are contained respectively within the tubular portion and within the head-shaped portion of the outer enclosure, said first insert comprising, at an end that protrudes from the enclosure, means for coupling to a water feed duct such that water is conveyed in said first and second inserts and water is prevented from contacting said enclosure, said first insert being provided with axial locking means which comprise a U-shaped element engaged with a receptacle formed in the outer enclosure, abutting against a protrusion provided on said first insert.

2. The shower head according to claim 1, wherein said second insert comprises the jet opening and closing device.

3. The shower head according to claim 2, wherein the second insert, contained within the head-shaped portion of the outer enclosure, is provided with axial locking means.

4. An on-off shower head, comprising:

an outer enclosure, a jet opening and closing device, water conveyance means arranged within said enclosure, for preventing any contact of the water with said enclosure, said outer enclosure being shaped to form a tubular portion that is open at one end and is connected at an other end to a head-shaped portion, said water conveyance means comprising a first insert and a second insert that are lockable to each other and that are contained respectively within the tubular portion and within the head-shaped portion of the outer enclosure, said first insert comprising, at an end that protrudes from the enclosure, means for coupling to a water feed duct, said second insert comprising the jet opening and closing device, and said second insert, contained within the head-shaped portion of the outer enclosure, being provided with axial locking means, and said second insert, contained within the head-shaped portion of the outer enclosure, comprising:

a cylindrical wall, accommodated within the head-shaped portion of the outer enclosure, open at the outward end of said enclosure, and provided with a top at the other end, and further comprising, at a side wall, a port for the insertion of an end of the first insert;

a distribution unit, which is accommodated within said cylindrical wall and kept in position in abutment against said top thereof and is provided with water flow channels, which are open at their two ends and are comprised in a peripheral ring, a portion of space comprised within said ring being open at the end that is directed toward the outside of the enclosure and being provided, at its other end, with a cap, which comprises water flow openings, a plurality of ridges being provided for ensuring connection between said ports and the channels comprised in the peripheral ring, a port being further provided at the side wall and mating with the end of the first insert;

an annular element, which is associated with said cylindrical wall and which delimits a central portion of space that is provided with means for blocking the flow of water comprised in a peripheral ring provided with water flow channels, said means being arranged as a continuation of the channels comprised within the peripheral ring of the distribution unit;

a flow control element, which is associated with a rod for operation by an operator by means of a button in contrast with a spring in order to open and close the jet by moving between two positions that are respectively out of contact and in contact with the cap of the dispensing unit.

5. The shower head according to claim 4, wherein said annular element comprises, at a central portion of space, a blind plug for blocking the passage of water.

6. The shower head according to claim 5, wherein the annular element comprises a monolithic screen for blocking the passage of water at the central portion of space.

7. The shower head according to claim 4, wherein the annular element is associated with the cylindrical wall by means of a thread and comprises a surface that abuts against the distribution unit in order to keep said distribution unit in position and in abutment against the top of said cylindrical wall.

8. The shower head according to claim 4, wherein the cylindrical wall is provided with means for coupling to the outer enclosure.

9. The shower head according to claim 4, wherein the cylindrical wall is provided with means for coupling to the outer enclosure, which comprise at least one tab arranged for entering, as a consequence of the motion of said cylindrical wall in an axial direction, a receptacle provided in said enclosure in order to lock the cylindrical wall upon rotation thereof about its own axis, rotation in an opposite direction being prevented by coupling with the first insert.

10. The shower head according to claim 4, wherein the cylindrical wall is provided with means for coupling to the outer enclosure, which comprise at least two mushroom-shaped tabs that protrude from the top of said cylindrical wall and are adapted to enter, by moving in an axial direction, respective holes provided in a flat ridge that is rigidly coupled to said enclosure, in order to lock the cylindrical wall upon rotation thereof about its own axis, entering slots provided as a continuation of said holes, rotation in the opposite direction being prevented by coupling with the first insert.

* * * * *